US010920774B2

(12) United States Patent
Matsui et al.

(10) Patent No.: US 10,920,774 B2
(45) Date of Patent: Feb. 16, 2021

(54) SCROLL COMPRESSOR AND REFRIGERATION CYCLE APPARATUS

(71) Applicant: Mitsubishi Electric Corporation, Tokyo (JP)

(72) Inventors: Tomokazu Matsui, Tokyo (JP); Kohei Tatsuwaki, Tokyo (JP); Yuji Takamura, Tokyo (JP); Shinya Morita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 180 days.

(21) Appl. No.: 16/071,270

(22) PCT Filed: Mar. 8, 2017

(86) PCT No.: PCT/JP2017/009267
§ 371 (c)(1),
(2) Date: Jul. 19, 2018

(87) PCT Pub. No.: WO2017/169596
PCT Pub. Date: Oct. 5, 2017

(65) Prior Publication Data

US 2019/0195224 A1 Jun. 27, 2019

(30) Foreign Application Priority Data

Mar. 31, 2016 (WO) ..... PCT/JP2016/060630

(51) Int. Cl.
*F03C 2/00* (2006.01)
*F03C 4/00* (2006.01)
(Continued)

(52) U.S. Cl.
CPC ..... *F04C 18/0215* (2013.01); *F04C 18/02* (2013.01); *F04C 23/008* (2013.01);
(Continued)

(58) Field of Classification Search
CPC .. F04C 18/02; F04C 18/0215; F04C 18/0246; F04C 18/0253; F04C 23/008;
(Continued)

(56) References Cited

U.S. PATENT DOCUMENTS 4,875,838 A * 10/1989 Richardson, Jr. ..... F04C 29/023 418/55.6
5,395,224 A * 3/1995 Caillat ..... F04C 29/023 418/55.6
(Continued)

FOREIGN PATENT DOCUMENTS

EP 0 348 601 A2 1/1990
EP 0 469 700 A1 2/1992
(Continued)

OTHER PUBLICATIONS

JP 2001003883A—Sato et al.—Scroll Type Fluid Machine—Jan. 9, 2001—English Machine Translation (Year: 2001).*
(Continued)

*Primary Examiner* — Theresa Trieu
(74) *Attorney, Agent, or Firm* — Posz Law Group, PLC

(57) ABSTRACT

A scroll compressor includes a crank shaft, an orbiting scroll, and a frame. The crank shaft has a lubricant channel. The orbiting scroll has an inner channel and a lubricant channel groove. The inner channel allows the lubricant supplied through the crank shaft to flow outward. The lubricant channel groove has an annular shape and allows the lubricant supplied through the inner channel to be supplied to the thrust surface. The lubricant channel groove is formed such that the lubricant channel groove stays within a region of the thrust surface while the orbiting scroll is orbiting.

16 Claims, 7 Drawing Sheets

(51) Int. Cl.

| | |
|---|---|
| ***F04C 2/00*** | (2006.01) |
| ***F04C 18/00*** | (2006.01) |
| ***F04C 18/02*** | (2006.01) |
| ***F04C 23/00*** | (2006.01) |
| ***F04C 27/00*** | (2006.01) |
| ***F04C 29/00*** | (2006.01) |
| ***F04C 29/02*** | (2006.01) |

(52) U.S. Cl.
CPC ..... *F04C 27/005* (2013.01); *F04C 27/008* (2013.01); *F04C 29/0057* (2013.01); *F04C 29/023* (2013.01); *F04C 2240/56* (2013.01)

(58) Field of Classification Search
CPC .... F04C 27/005; F04C 27/008; F04C 29/023; F04C 29/0057; F04C 2240/56
USPC ..... 418/55.1–55.6, 57, 88, 94, 151, 270
See application file for complete search history.

(56) References Cited

U.S. PATENT DOCUMENTS

| | | | | |
|---|---|---|---|---|
| 7,556,482 | B2 * | 7/2009 | Benco | F04C 29/023 418/55.6 |
| 8,672,646 | B2 * | 3/2014 | Ishizono | F04C 18/0215 418/55.1 |
| 2002/0131879 | A1 * | 9/2002 | Fenocchi | F04C 29/023 418/55.6 |
| 2002/0134101 | A1 | 9/2002 | Gennami et al. | |
| 2002/0136652 | A1 | 9/2002 | Gennami et al. | |
| 2004/0241028 | A1 * | 12/2004 | Witham | F04C 27/005 418/55.5 |
| 2010/0050122 | A1 * | 2/2010 | Nakajima | F01C 17/066 418/55.3 |
| 2014/0234148 | A1 | 8/2014 | Takeda et al. | |
| 2016/0348680 | A1 | 12/2016 | Okamoto | |

FOREIGN PATENT DOCUMENTS

| | | | | | |
|---|---|---|---|---|---|
| GB | 2 396 886 | A | | 7/2004 | |
| JP | H01-106995 | A | | 4/1989 | |
| JP | H05-149277 | A | | 6/1993 | |
| JP | 2001003883 | A | * | 1/2001 | F04C 18/02 |
| JP | 2002-285982 | A | | 10/2002 | |
| JP | 2011-021511 | A | | 2/2011 | |
| JP | 2013-224606 | A | | 10/2013 | |
| JP | 2013-227955 | A | | 11/2013 | |
| JP | 2014-163230 | A | | 9/2014 | |
| JP | 2014-169677 | A | | 9/2014 | |
| KR | 20020060901 | A | * | 7/2002 | F04C 18/02 |
| WO | 2015/155802 | A1 | | 10/2015 | |

OTHER PUBLICATIONS

KR20020060901A—Cho—Structure for Feeding Oil in Scroll Compressor—Jul. 19, 2002—English Machine Translation (Year: 2002).*
International Search Report ("ISR") dated Jun. 6, 2017 issued in corresponding International patent application No. PCT/JP2017/009267 (with English translation).
Extended European Search Report dated Dec. 3, 2018 issued in corresponding European patent application No. 17774141.0.

* cited by examiner

SCROLL COMPRESSOR AND REFRIGERATION CYCLE APPARATUS

CROSS REFERENCE TO RELATED APPLICATION

This application is a U.S. national stage application of PCT/JP2017/009267 filed on Mar. 8, 2017, which claims priority to International Patent Application No. PCT/JP2016/060630 filed on Mar. 31, 2016, the contents of which are incorporated herein by reference.

TECHNICAL FIELD

The present invention relates to a scroll compressor and a lubricant supplying structure.

BACKGROUND ART

In a scroll compressor, an orbiting scroll orbits against a fixed scroll, thereby compressing refrigerant in a compression space defined by scroll laps of the orbiting scroll and the fixed scroll. This orbiting scroll is accommodated in a frame. A thrust load produced during orbiting of the orbiting scroll is supported by a thrust bearing provided in the frame. During the orbiting of the orbiting scroll, the orbiting scroll slides against the thrust bearing of the frame. Thus, it is required that lubricant be supplied to the thrust bearing to prevent seizure or other defect. A variety of methods have been proposed as a method of supplying lubricant to the thrust bearing.

For example, there is a structure with which lubricant sucked up by a crank shaft is stored in a space between a frame and an orbiting scroll, and the lubricant is caused to overflow to be supplied to a thrust bearing (for example, see Patent Literature 1).

Furthermore, there is a structure in which an annular groove is provided in a lower surface of an orbiting scroll to supply lubricant to a thrust bearing (for example, see Patent Literature 2). Furthermore, there is a structure in which an annular groove in a lower surface of an orbiting scroll and a drive bushing chamber are connected to each other through a lubricant hole (for example, see Patent Literature 3).

CITATION LIST

Patent Literature

Patent Literature 1: Japanese Unexamined Patent Application Publication No. 2014-169677

Patent Literature 2: International Publication No. 2015/155802

Patent Literature 3: Japanese Unexamined Patent Application Publication No. 5-149277

SUMMARY OF INVENTION

Technical Problem

However, in the case of a test run or startup after a long-time stop, the lubricant is not stored in the frame. Thus, with the structure of Patent Literature 1, the lubricant cannot be supplied to the thrust bearing for a period of time from when operation of the compressor is started to when the lubricant overflows. This inability may lead to a failure of the compressor due to seizure.

Furthermore, according to Patent Literature 2 and Patent Literature 3, the annular groove is formed in a comparatively central region in the lower surface of the orbiting scroll. Thus, effective supply of the lubricant to the thrust bearing may fail during the orbiting of the orbiting scroll. This failure may lead to lubricant shortage at the thrust bearing.

The present invention has been made to address the above-described problem. An object of the present invention is to provide a scroll compressor and a refrigeration cycle apparatus in which sufficient lubricant can be supplied to a thrust bearing.

Solution to Problem

A scroll compressor of one embodiment of the present invention includes a crank shaft, an orbiting scroll, and a frame. The crank shaft has a lubricant channel allowing lubricant to flow through the lubricant channel. The orbiting scroll is attached to the crank shaft and includes a base plate that is discoidal. The frame has a thrust surface against which the orbiting scroll slides. The thrust surface has an annular shape and faces an outer circumferential region of one surface of the base plate of the orbiting scroll. The orbiting scroll has an inner channel and a lubricant channel groove. The inner channel allows the lubricant supplied through the crank shaft to flow outward. The lubricant channel groove has an annular shape in the outer circumferential region of the one surface of the base plate facing the thrust surface and allows the lubricant supplied through the inner channel to be supplied to the thrust surface. The lubricant channel groove is formed such that the lubricant channel groove stays within a region of the thrust surface while the orbiting scroll is orbiting.

Advantageous Effects of Invention

According to one embodiment of the present invention, the scroll compressor and the refrigeration cycle apparatus in which sufficient lubricant can be supplied to the thrust bearing can be provided.

DESCRIPTION OF EMBODIMENTS

Figure 1:
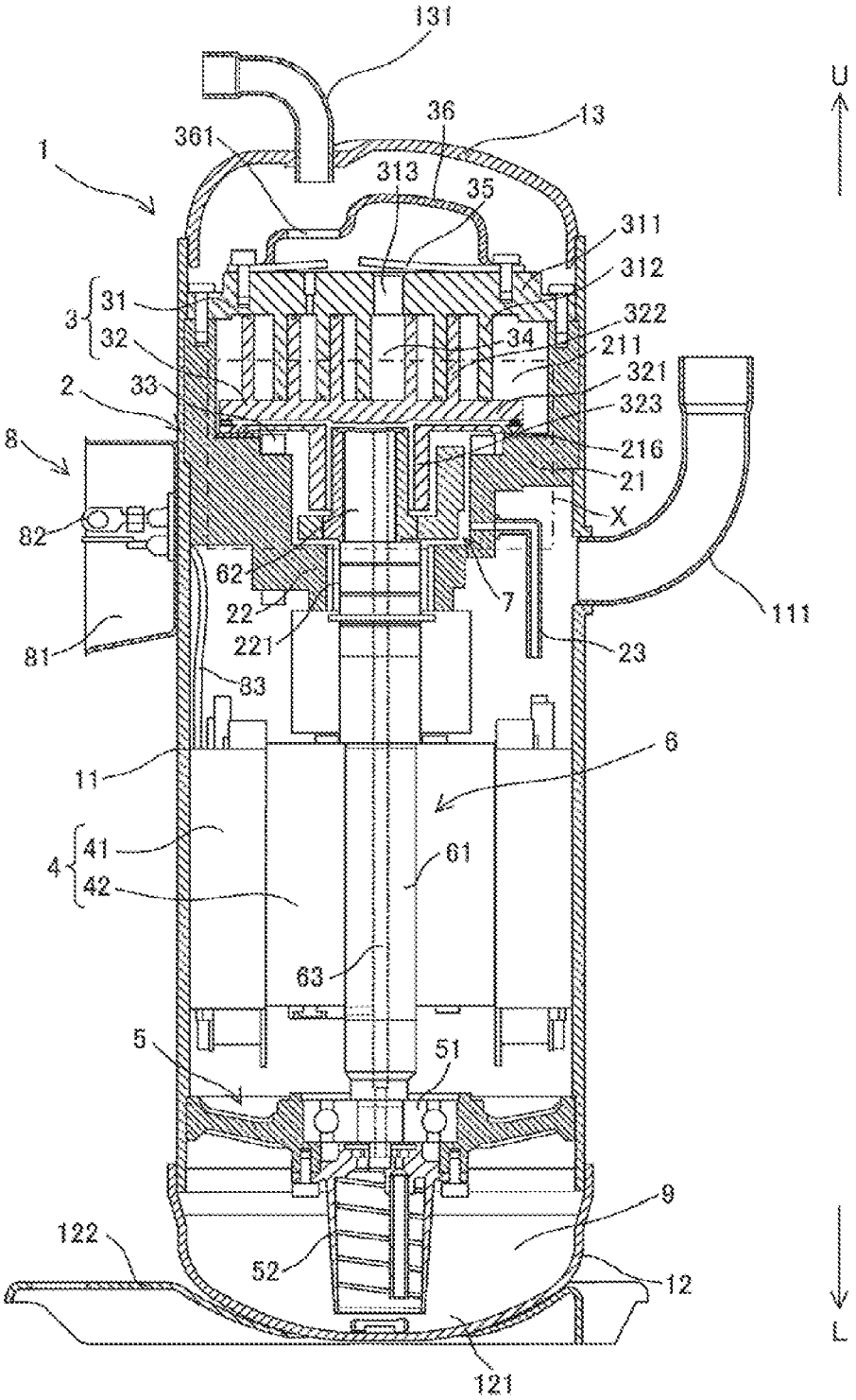
FIG. 1 is a schematic longitudinal sectional view of a scroll compressor according to Embodiment 1 of the present invention.

Embodiments of the present invention will be described below with reference to the drawings. In the drawings, the same or equivalent parts are denoted with the same reference signs, thereby description of the parts is appropriately omitted or simplified. Furthermore, the shapes, sizes, arrangements, and other aspects of structures illustrated in the drawings can be appropriately changed within the scope of the present invention.

Embodiment 1

Figure 2:
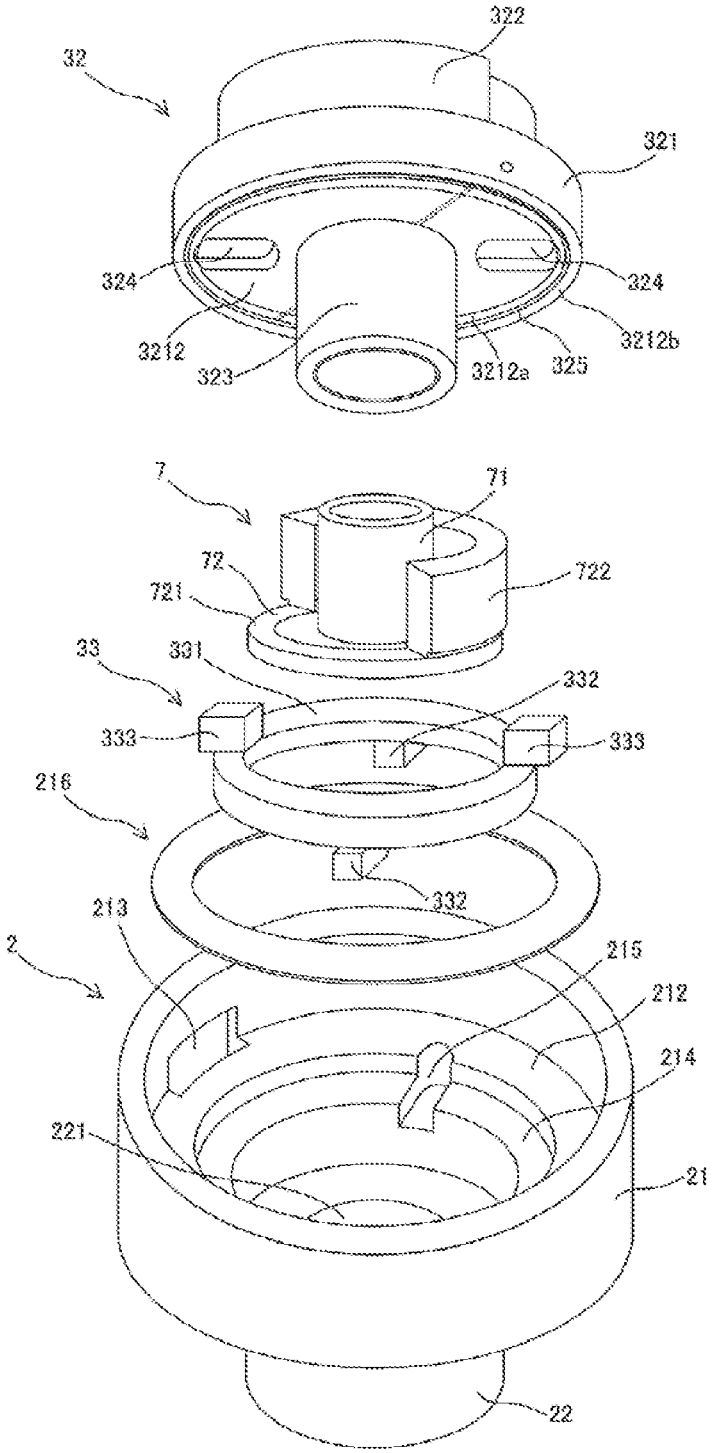
FIG. 2 is an exploded perspective view of a main frame, an orbiting scroll, and other components of the scroll compressor according to Embodiment 1 of the present invention.

Embodiment 1 is described below. FIG. 1 is a schematic longitudinal sectional view of a scroll compressor according to Embodiment 1. FIG. 2 is an exploded perspective view of a main frame, an orbiting scroll, and other components of the scroll compressor according to Embodiment 1 of the present invention. The compressor illustrated in FIG. 1 is a vertical scroll compressor to be used with the central axis of a crank shaft, which will be described later, being substantially vertical to the ground. Regarding the directions, the upper portion is referred to as one end portion U, and the lower portion (portion close to the ground) is referred to as an other end portion L for description.

The scroll compressor includes a shell 1, a main frame 2, a compression mechanism unit 3, a drive mechanism unit 4, a sub-frame 5, a crank shaft 6, a bushing 7, and a power feed unit 8.

The shell 1 made of an electrically conductive material such as metal is a cylindrical housing having both ends that are closed. The shell 1 includes a main shell 11, a lower shell 12, and an upper shell 13. The main shell 11 has a cylindrical shape and includes a suction pipe 111 at a side wall of the main shell 11. The suction pipe 111 is for introducing refrigerant into the shell 1 and communicates with the inside of the main shell 11. The lower shell 12 is a substantially semispherical bottom body. A part of a side wall of the lower shell 12 is connected to the lower end part of the main shell 11 by, for example, welding. Thus, an opening at the lower portion of the main shell 11 is closed by the lower shell 12.

At least a part of the inside of the lower shell 12 is used as a lubricant storage 121 in which lubricant 9 is stored. The upper shell 13 is a substantially semispherical lid body. A part of a side wall of the upper shell 13 is connected to the upper end part of the main shell 11 by, for example, welding. Thus, an opening at the upper portion of the main shell 11 is closed by the upper shell 13. The upper shell 13 includes a discharge pipe 131 at an upper part of the upper shell 13. The discharge pipe 131 is for discharge of the refrigerant from the shell 1 and communicates with an inner space of the main shell 11. The shell 1 is supported by a fixing base 122 having a plurality of threaded holes. The scroll compressor can be fixed to another part such as a housing of an outdoor unit by screwing screws into these threaded holes.

The main frame 2 is a hollow metal supporting part and has an opening at a portion of the main frame 2 close to the one end portion U. The main frame 2 is disposed in the shell 1. The main frame 2 includes a main body part 21, a main bearing part 22, and a lubricant return pipe 23. The main body part 21 is fixedly supported on an inner circumferential surface of a portion of the main shell 11 close to the one end portion U by shrinkage fitting, welding, or other method. An accommodating space 211 is defined in the main body part 21 along the longitudinal direction of the shell 1. The accommodating space 211 is open at a portion of the accommodating space 211 close to the one end portion U and has a stepped shape in which the inner space reduces stepwise toward the other end portion L. As illustrated in FIG. 2, one of surfaces of the stepped portion facing the one end portion U corresponds to a thrust surface 212 having a ring shape.

The main frame 2 has refrigerant channels 213. Each of the refrigerant channels 213 is disposed in a part of an outer circumferential portion of the thrust surface 212 and a part of an inner wall surface of the main frame 2 continuous with the part of the thrust surface 212. The refrigerant channels 213 are holes through which the inside and the outside of the main frame 2 are spatially communicated with each other. A pair of the refrigerant channels 213 are provided to be arranged on a substantially straight line across the axis of the crank shaft 6 (for example, the central axis of a main shaft part 61, which will be described later).

Furthermore, an Oldham disposing part 214 is formed at a part of the step portion of the main frame 2 closer the other end portion L than is the thrust surface 212. The Oldham disposing part 214 has first Oldham grooves 215. The outer end portion of each of the first Oldham grooves 215 extends to a part of the inner circumferential portion of the thrust surface 212. A pair of the first Oldham grooves 215 are provided to be arranged on a substantially straight line across the axis of the crank shaft 6. The first Oldham grooves 215 each correspond to a frame Oldham groove of the present invention.

A thrust plate 216 made of a steel-based material is disposed on the thrust surface 212. The thrust plate 216 has a ring-shape and is disposed on the thrust surface 212, thereby covering a part of each of the refrigerant channels 213 and a part of each of the first Oldham grooves 215. Thus, the thrust plate 216 serves as a thrust bearing according to Embodiment 1.

The main bearing part 22 is formed at a portion closer to the other end portion L than is the main body part 21 and continuous with the main body part 21. The main bearing part 22 has a shaft hole 221 inside the main bearing part 22. The shaft hole 221 vertically penetrates through the main bearing part 22. A portion of the shaft hole 221 close to the one end portion U communicates with the accommodating space 211. The lubricant 9 stored in the accommodating space 211 is returned to the lubricant storage 121 of the lower shell 12 through the lubricant return pipe 23. The lubricant return pipe 23 is connected to a lubricant discharge hole 218 opened in a wall part 217 facing a weight part 722 of the bushing 7, which will be described later.

The lubricant 9 is a refrigerating machine oil containing, for example, an ester-based synthetic oil. The lubricant 9 is stored in the lubricant storage 121 of the lower shell 12. The lubricant 9, through a lubricant channel 63 of the crank shaft 6, reduces wear of parts in mechanical contact with one another, adjusts the temperatures of sliding portions, and improves sealing properties. Preferably, the lubricant 9 has, for example, good lubricating characteristics, good electrical insulating properties, high stability, high dissolubility in the refrigerant, and high fluidity at low-temperature. It is also preferable that the lubricant 9 has an appropriate viscosity.

The compression mechanism unit 3 compresses the refrigerant. According to Embodiment 1, the compression mechanism unit 3 is a scroll compression mechanism that includes a fixed scroll 31 and an orbiting scroll 32. The fixed scroll 31 is made of metal such as aluminum and cast iron and includes a first base plate 311 and a first scroll body 312.

The first base plate 311 has a discoidal shape. An outer end part of the first base plate 311 is in contact with the main body part 21 and fixed to the main frame 2 with screws or other component. The first scroll body 312 projects from a surface of the first base plate 311 close to the other end portion L to form a scroll-shaped wall. A distal end of the first scroll body 312 faces the other end portion L. The orbiting scroll 32 is made of metal such as aluminum and cast iron and includes a second base plate 321, a second scroll body 322, a cylindrical part 323, and second Oldham grooves 324.

The second base plate 321 has a discoidal shape. The second base plate 321 is supported (borne) by the main frame 2 such that at least a part of an outer circumferential region of an other-end surface 3212 is slidable against the thrust surface 212, which is the thrust plate 216 according to Embodiment 1. The second scroll body 322 projects from a one-end surface 3211 of the second base plate 321 to form a scroll-shaped wall. A distal end of the second scroll body 322 faces the one end portion U. A sealing part that reduces leakage of the refrigerant is provided at the distal end part of each of the first scroll body 312 of the fixed scroll 31 and the second scroll body 322 of the orbiting scroll 32. The cylindrical part 323 is a cylindrical boss that projects from the center or the proximity of the center of the other-end surface 3212 of the second base plate 321 toward the other end portion L.

The second Oldham grooves 324 each have an oblong circular shape and are formed in the other-end surface 3212 of the second base plate 321. A pair of the second Oldham grooves 324 are provided to be arranged on a substantially straight line across the axis of the crank shaft 6. The second Oldham grooves 324 each correspond to an orbiting-scroll Oldham groove of the present invention.

Furthermore, an Oldham ring 33 is provided in the Oldham disposing part 214 of the main frame 2. The Oldham ring 33 includes a ring part 331, first projections 332, and second projections 333. The ring part 331 has a ring shape and is disposed in a space defined between the main frame 2 and the second base plate 321 of the orbiting scroll 32. A pair of the first projections 332 are formed on a surface of the ring part 331 close to the other end portion L and face each other. A pair of the second projections 333 are formed on a surface of the ring part 331 close to the one end portion U and face each other. The pair of first projections 332 are accommodated in the pair of first Oldham grooves 215 of the main frame 2. The pair of second projections 333 are accommodated in the pair of second Oldham grooves 324 of the orbiting scroll 32. Thus, when the orbiting scroll 32 orbits due to rotation of the crank shaft 6, the Oldham ring 33 prevents the orbiting scroll 32 from rotating about its own axis.

A compression space 34 is defined by engaging the first scroll body 312 of the fixed scroll 31 and the second scroll body 322 of the orbiting scroll 32 with each other. The compression space 34 includes a plurality of sub-compression spaces. The volumes of the sub-compression spaces reduce from the radially outer side toward the radially inner side. The refrigerant is sucked in from outer ends of the scroll bodies and the orbiting scroll 32 orbits. This action gradually compresses the refrigerant. The compression space 34 communicates with a discharge port 313 that penetrates through a central part of the first base plate 311 of the fixed scroll 31. The compressed refrigerant is discharged through this discharge port 313. A discharge valve 35 and a muffler 36 are fixed to a surface of the fixed scroll 31 close to the one end portion U with, for example, screws. The discharge valve 35 opens and closes the discharge port 313 as specified to prevent backflow of the refrigerant. The muffler 36 has a discharge hole 361 and covers the discharge port 313 and the discharge valve 35.

The refrigerant is, for example, halogenated hydrocarbon having a double bond of carbon in the composition, halogenated hydrocarbon having no double bond of carbon in the composition, hydrocarbon, or a mixture containing one of these hydrocarbons. Examples of the halogenated hydrocarbon having a double bond of carbon include an HFO refrigerant having zero ozone depletion potential and tetrafluoropropene such as HFO1234yf, HFO1234ze, and HFO1243zf, which are each a fluorocarbon-based low GWP refrigerant and represented by a chemical formula $C_3H_2F_1$. Examples of the halogenated hydrocarbon having no double bond of carbon include a refrigerant mixed with R32 (difluoromethane) represented as $CH_2F_2$, R41, or other similar refrigerant. Examples of the hydrocarbon include a natural refrigerant such as propane and propylene. Examples of the mixture include a mixed refrigerant in which HFO1234yf, HFO1234ze, HFO1243zf, or other similar refrigerant is mixed with R32, R41, or other similar refrigerant.

The drive mechanism unit 4 is provided at a portion closer to the other end portion L than is the main frame 2 in the shell 1. The drive mechanism unit 4 includes a stator 41 and a rotor 42. The stator 41 has a ring shape and is formed by, for example, winding a wire around a core, which is formed by laminating a plurality of electromagnetic steel sheets, with an insulating layer interposed between the core and the wire. An outer circumferential surface of the stator 41 is fixedly supported at the inside of the main shell 11 by shrinkage fitting or other method. The rotor 42 includes a permanent magnet disposed in a core formed by laminating a plurality of electromagnetic steel sheets. The rotor 42 has a cylindrical shape having a through hole that vertically penetrates through the rotor 42 at the center. The rotor 42 is disposed in an inner space of the stator 41.

The sub-frame 5 is a metal supporting part and provided at a portion closer to the other end portion L than is the drive mechanism unit 4 in the shell 1. The sub-frame 5 is fixedly supported on an inner circumferential surface of a portion of the main shell 11 close to the other end portion L by shrinkage fitting, welding, or other method. The sub-frame 5 includes a sub-bearing part 51 and an oil pump 52. The sub-bearing part 51 is a ball bearing provided at an upper central part of the sub-frame 5. The sub-bearing part 51 has a hole that vertically penetrates through at its center. The oil pump 52 is provided at a lower central part of the sub-frame 5. The oil pump 52 is disposed such that at least a part of the oil pump 52 is immersed in the lubricant 9 stored in the lubricant storage 121 of the shell 1.

The crank shaft 6 is a rod-shaped long metal part and provided in the shell 1. The crank shaft 6 includes the main shaft part 61, an eccentric shaft part 62, and the lubricant channel 63. An outer surface of the main shaft part 61 is press-fitted into and fixed to the through hole of the rotor 42. The central axis of the main shaft part 61 corresponds to the central axis of the main shell 11. The eccentric shaft part 62 is provided at a portion closer to the one end portion U than is the main shaft part 61 such that the central axis of the eccentric shaft part 62 is decentered from the central axis of the main shaft part 61. The lubricant channel 63 vertically penetrates through the main shaft part 61 and the eccentric shaft part 62. The eccentric shaft part 62 of the crank shaft 6 close to the one end portion U is inserted into and fixed to the cylinder of the cylindrical part 323. A portion of the crank shaft 6 close to the other end portion L is inserted into and fixed to the sub-bearing part 51 of the sub-frame 5. Thus, the main shaft part 61 of the crank shaft 6 is positioned in the main bearing part 22 of the main frame 2, and an outer surface of the rotor 42 is disposed in the stator 41 with a specified gap maintained between the outer surface of the rotor 42 and an inner surface of the stator 41.

The bushing 7 connects the orbiting scroll 32 and the crank shaft 6 to each other. According to Embodiment 1, the bushing 7 includes two parts, that is, a slider 71 and a balance weight 72. The slider 71 is a cylindrical part made of, for example, metal such as iron. The slider 71 is fitted onto the eccentric shaft part 62 and fitted into the cylindrical part 323.

The balance weight 72 is a ring-shaped part made of, for example, metal such as iron. The balance weight 72 includes an annular part 721 and the weight part 722. The annular part 721 has a ring shape. An inner surface of the annular part 721 is engaged with an outer surface of a flange of the slider 71 by a method such as shrinkage fitting. As illustrated in FIG. 2, the weight part 722 is a weight having a substantially C shape seen from the one end portion U. The weight part 722 is formed on a surface of the annular part 721 close to the one end portion U. The weight part 722 is disposed at a portion further to the outside than is the cylindrical part 323, specifically, disposed in a portion of the accommodating space 211 defined by the main frame 2, the second base plate 321, and the cylindrical part 323, that is, a space to serve as an intra-frame lubricant storage.

The power feed unit 8 feeds power to the scroll compressor and is provided on an outer circumferential surface of the main shell 11 of the shell 1. The power feed unit 8 includes a cover 81, a power feed terminal 82, and wiring 83. The cover 81 has a bottom and an opening. The power feed terminal 82 includes a metal part. One side of the power feed terminal 82 is provided inside the cover 81 and the other side of the power feed terminal 82 is provided in the shell 1. The wiring 83 is connected to the power feed terminal 82 at one end and connected to the stator 41 at the other end.

Figure 3:
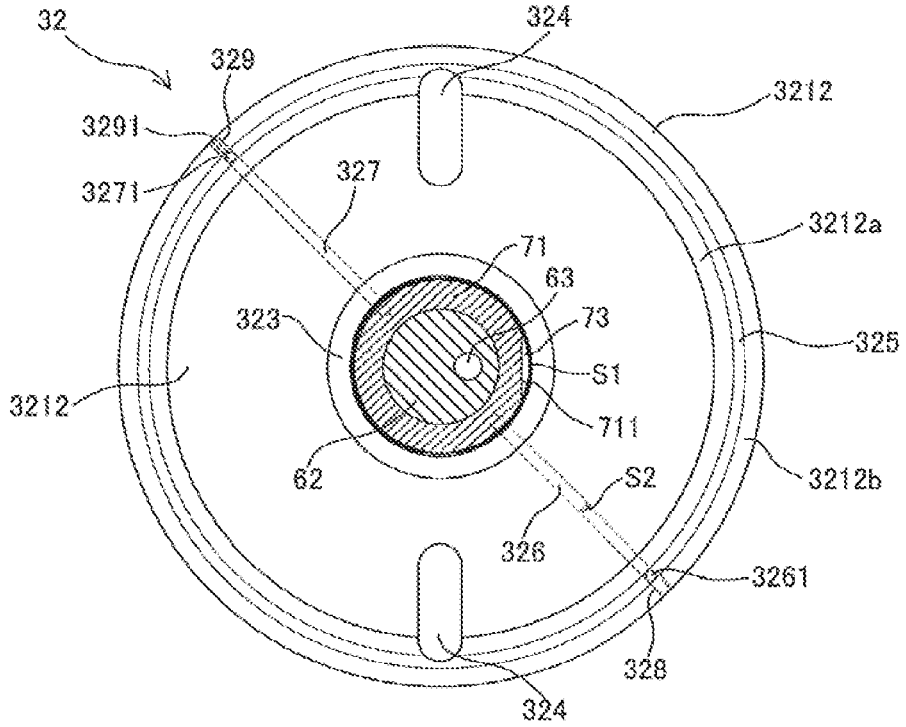
FIG. 3 illustrates the orbiting scroll seen from an other end portion L.

Next, further details of the structure of the orbiting scroll 32 are described with reference to FIG. 3. FIG. 3 illustrates the orbiting scroll seen from the other end portion L. The eccentric shaft part 62 of the crank shaft 6 and the slider 71 of the bushing 7 disposed in the cylindrical part 323 of the orbiting scroll 32 are sectioned.

As can be seen from FIG. 3, the orbiting scroll 32 further includes a lubricant channel groove 325, a first inner channel 326, and a second inner channel 327. The lubricant channel groove 325 is an annular groove formed in an outer circumferential region of the other-end surface 3212 of the second base plate 321. Parts of the lubricant channel groove 325 are spatially continuous with the pair of second Oldham grooves 324. A first sliding surface 3212*a* is formed at a portion further to the inside than is the lubricant channel groove 325 and a second sliding surface 3212*b* is formed at a portion further to the outside than is the lubricant channel groove 325. That is, the lubricant channel groove 325 is interposed between the first sliding surface 3212*a* and the second sliding surface 3212*b*. An outer circumferential portion of the first sliding surface 3212*a* and an inner circumferential portion of the lubricant channel groove 325 are continuously connected to each other, and an outer circumferential portion of the lubricant channel groove 325 and an inner circumferential portion of the second sliding surface 3212*b* are continuously connected to each other. Preferably, the width of the second sliding surface 3212*b* is smaller than the width of the first sliding surface 3212*a*. Here, "sliding surface" refers to a surface to slide against the thrust bearing while the orbiting scroll is orbiting. Thus, the sliding surface is not determined only by the orbiting scroll 32. The sliding surface is determined depending on the positional relationship between the orbiting scroll 32 and the thrust bearing.

The first inner channel 326 is connected to the inside of the cylindrical part 323 at one end and connected to the lubricant channel groove 325 at the other end. The second inner channel 327 has the similar structure to the structure of the first inner channel 326. The second inner channel 327 is provided in a portion facing the first inner channel 326 across the axis of the crank shaft 6. The first inner channel 326 and the center of the second base plate 321 are provided on a substantially straight line.

As illustrated in FIG. 3, a flat surface 711 is formed on an outer wall surface of the slider 71. A lubricant flowing space 73 is defined by the flat surface 711 of the bushing 7 and an inner wall surface of the cylindrical part 323. When the sectional area of the lubricant flowing space 73 is S1 and the sectional area of the first inner channel 326 is S2, a relationship of S1>S2 is satisfied.

When the lubricant 9 flows, resistance is smaller in the lubricant flowing space 73 than in the first inner channel 326. Thus, when the amount of the lubricant 9 flowing through the lubricant flowing space 73 is M1 and the amount of the lubricant 9 flowing through the first inner channel 326 is M2, a relationship of M1>M2 can be established. Thus, the amount of the lubricant 9 supplied to a portion where friction is produced between the main bearing part 22 and the crank shaft 6 is larger than the amount of the lubricant 9 supplied to a portion where the orbiting scroll 32 slides against the thrust bearing. Furthermore, when a relationship of $0.05<M2/(M1+M2)<0.3$ is satisfied, an appropriate balance between the amount of the lubricant 9 supplied to the portion where friction is produced between the main bearing part 22 and the crank shaft 6 and the amount of the lubricant 9 supplied to the portion where the orbiting scroll 32 slides against the thrust bearing can be obtained.

The amount M1 of the lubricant 9 flowing through the lubricant flowing space 73 and the amount M2 of the lubricant 9 flowing through the first inner channel 326 can be adjusted by the sectional area S1 of the lubricant flowing space 73 or the sectional area S2 of the first inner channel 326 or by, for example, providing resistance in the channel. The relationship between the second inner channel 327 and the lubricant flowing space 73 is similar to the relationship between the first inner channel 326 and the lubricant flowing space 73.

Figure 4:
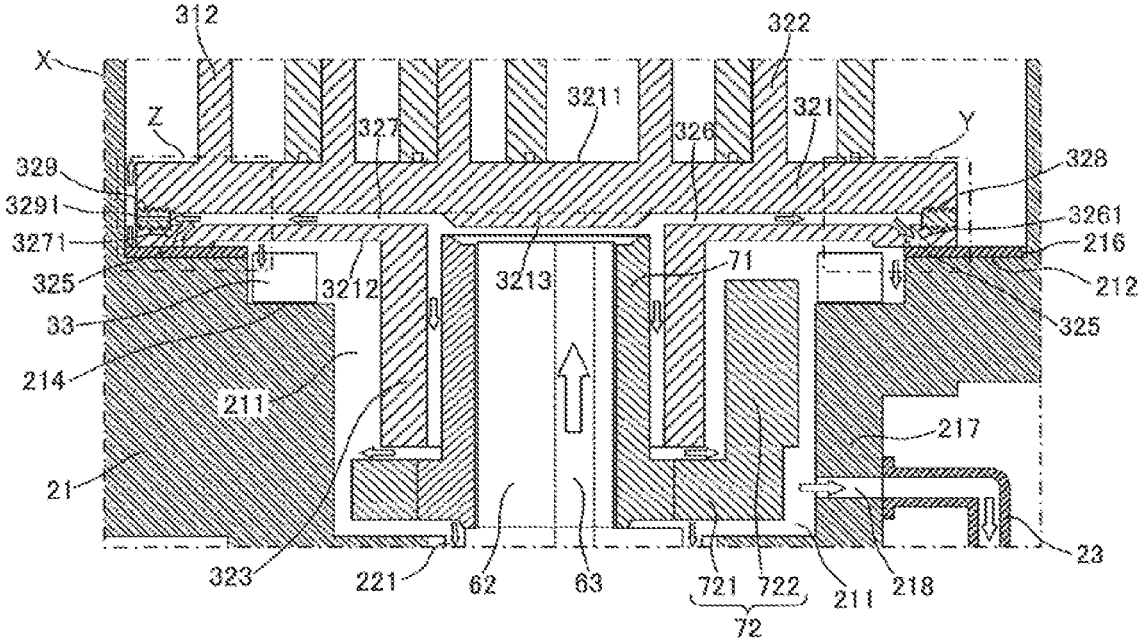
FIG. 4 is an enlarged view of a region surrounded by a dotted chain line X illustrated in FIG. 1.
Figure 5:
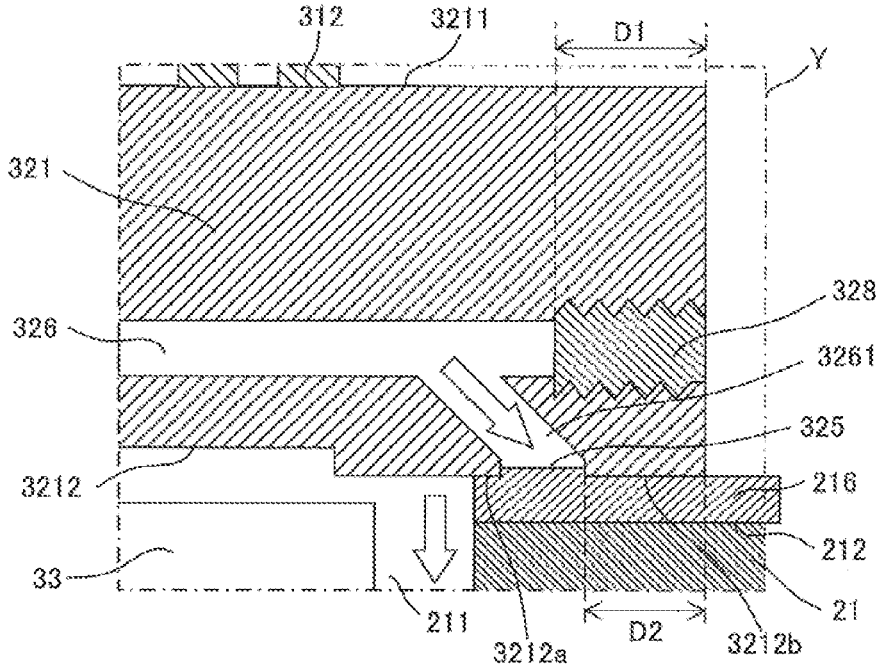
FIG. 5 is an enlarged view of a region surrounded by a dotted chain line Y illustrated in FIG. 4.
Figure 6:
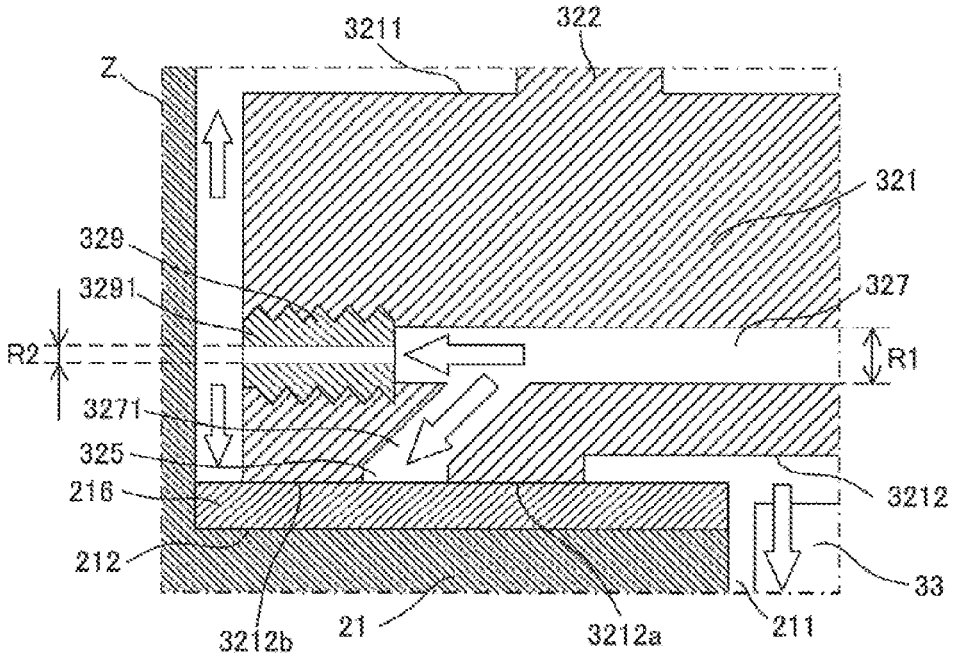
FIG. 6 is an enlarged view of a region surrounded by a dotted chain line Z illustrated in FIG. 4.

Further details of the first inner channel 326, the second inner channel 327, and other components are described with reference to FIGS. 4 to 6. FIG. 4 is an enlarged view of a region surrounded by a dotted chain line X illustrated in FIG. 1. FIG. 5 is an enlarged view of a region surrounded by a dotted chain line Y illustrated in FIG. 4. FIG. 6 is an enlarged view of a region surrounded by a dotted chain line Z illustrated in FIG. 4.

As illustrated in FIG. 4, the first inner channel 326 and the second inner channel 327 are formed along the other-end surface 3212 of the second base plate 321. The state expressed as "along the other-end surface 3212" is optimum when the first inner channel 326 and the second inner channel 327 are parallel to the other-end surface 3212. However, a state in which the first inner channel 326 and the second inner channel 327 are inclined to the other-end surface 3212 by about ±10 degrees is tolerable. A thickness part 3213 that is frusta-conical, the diameter of which gradually reduces toward the other end portion L, is formed at inner ends of the first inner channel 326 and the second inner channel 327 inside the cylindrical part 323, that is, around the center of the other-end surface 3212 of the second base plate 321.

The thickness part 3213 produces an effect of ensuring the strength of a central part of the second base plate 321 to be subjected to a pressure increased by compression of the refrigerant. The thickness part 3213 also produces an effect of smoothly introducing the lubricant 9 sucked by the crank shaft 6 to the first inner channel 326 and the second inner channel 327 along an inclined surface of the thickness part 3213.

A first plug part 328 and a second plug part 329 are respectively inserted into an outer end of the first inner channel 326 and an outer end of the second inner channel 327 from side portions. The first plug part 328 and the second plug part 329 are, for example, metal screws each made of a material having linear expansion coefficient close to linear expansion coefficients of the fixed scroll 31 and the orbiting scroll 32. The first plug part 328 and the second plug part 329 are respectively inserted into and fixed to the first inner channel 326 and the second inner channel 327 by being screwed into respective thread grooves formed in the first inner channel 326 and the second inner channel 327. The first plug part 328 and the second plug part 329 close respective outer end portions of the first inner channel 326 and the second inner channel 327. As illustrated in FIG. 6, out of these plug parts, the second plug part 329 has a through hole 3291 at the center. The through hole 3291 penetrates through the second plug part 329 in the inside-outside direction. The second plug part 329 serves as an adjustment part with which a discharge amount of the lubricant 9 at the outer end portion of the second inner channel 327 (side surface of the second base plate 321) is adjusted. The details of the adjustment part will be described later.

The first inner channel 326 is a lateral hole and most of the lateral hole extends along the other-end surface 3212. Thus, the first inner channel 326 is connected to the lubricant channel groove 325 in the vicinity of the outer end of the first inner channel 326 through a first connection hole 3261. The first connection hole 3261 is opened in the second base plate 321 to be inclined to the other-end surface 3212 of the second base plate 321. Specifically, the first connection hole 3261 extends from the proximity of a distal end of the first plug part 328 of the first inner channel 326 toward a portion that is close to the other end portion L and close to the outside to be connected to the lubricant channel groove 325.

As illustrated in FIG. 5, when the length by which the first plug part 328 is inserted from the outer end surface of the second base plate 321 is D1 and a minimum distance between the outer end surface of the second base plate 321 and the first connection hole 3261 is D2, a relationship of D1>D2 is satisfied. That is, the first connection hole 3261 is opened through a portion of the second base plate 321 that is closer to the other end portion L than is the first plug part 328. Thus, the lubricant channel groove 325 can be formed at a position close to the outer end. Thus, when the orbiting scroll 32 is disposed in the main frame 2, the lubricant channel groove 325 easily faces the thrust surface 212 (thrust plate 216). Thus, the lubricant 9 can be effectively supplied to the thrust plate 216.

The widths of the first sliding surface 3212*a* and the second sliding surface 3212*b* can also be adjusted. Furthermore, as the first connection hole 3261 is inclined, the lubricant 9 flowing through the first inner channel 326 can smoothly flow into the lubricant channel groove 325. Also, the second inner channel 327 is connected to the lubricant channel groove 325 through a second connection hole 3271. The structure of the second connection hole 3271 is similar to the structure of the first connection hole 3261.

An example of a method of forming the first inner channel 326 and other components is described. First, the lubricant channel groove 325 is formed in an outer circumferential region of the other-end surface 3212 of the second base plate. Next, a hole is opened from the side surface of the second base plate 321 to an inner space of the cylindrical part 323 along the other-end surface 3212 by, for example, a drill. Thereby, the first inner channel 326 is formed. Then, a hole is opened by, for example, a drill in an inclined direction from the lubricant channel groove 325 toward a portion that is close to the one end portion U and close to the center of the second base plate 321, thereby the first connection hole 3261 connected to the first inner channel 326 is formed. At last, a thread groove is formed in a circumferential surface of the first inner channel 326 by specified distance from the side surface of the second base plate 321. With this method, the first inner channel 326 and other components can be easily formed. The second inner channel 327 is formed in a similar method.

Next, operation of the scroll compressor is described. When the power is supplied to the power feed terminal 82 of the power feed unit 8, torque is produced in the stator 41 and the rotor 42, thereby the crank shaft 6 is rotated. The rotation of the crank shaft 6 is transmitted to the orbiting scroll 32 through the eccentric shaft part 62 and the bushing 7. The rotation of the orbiting scroll 32 about its own axis is prevented by the Oldham ring 33, and the orbiting scroll 32 orbits in a decentered manner. At this time, the first sliding surface 3212*a* and the second sliding surface 3212*b* slide against the thrust plate 216. Thus, the lubricant channel groove 325 provided between the first sliding surface 3212*a* and the second sliding surface 3212*b* of the other-end surface 3212 of the orbiting scroll 32 does not protrude from the thrust plate 216 serving as the thrust bearing. That is, the lubricant channel groove 325 is in such a positional relationship with the thrust plate 216 that the lubricant channel groove 325 faces the thrust plate 216.

Meanwhile, the refrigerant sucked into the shell 1 through the suction pipe 111 enters the compression space 34 through the refrigerant channels 213 of the main frame 2. Then, as the orbiting scroll 32 orbits in a decentered manner, the refrigerant is reduced in volume and compressed while being moved from an outer circumferential part toward the center. The orbiting scroll 32 orbiting in a decentered manner is moved together with the bushing 7 in the radial direction due to the centrifugal force of the orbiting scroll 32, thereby the second scroll body 322 and the first scroll body 312 are brought into close contact with each other. This action prevents leakage of the refrigerant from a high-pressure portion to a lower-pressure portion in the compression space 34. Thus, the compression is performed with high efficiency. The compressed refrigerant is discharged through the discharge port 313 of the fixed scroll 31 while pushing against the discharge valve 35 and discharged from the shell 1 through the discharge hole 361 of the muffler 36 and the discharge pipe 131.

Here, when the orbiting scroll 32 orbits due to the rotation of the crank shaft 6, the lubricant 9 stored in the lubricant storage 121 of the shell 1 is sucked by the oil pump 52. The lubricant 9 passes through the lubricant channel 63 of the crank shaft 6 and flows into a space between a distal end of the eccentric shaft part 62 and the orbiting scroll 32, that is, an upflow lubricant storage. As illustrated in FIG. 4, the flow of the lubricant 9 having flowed into the upflow lubricant storage is split into a flow flowing through a space between the cylindrical part 323 of the orbiting scroll 32 and the slider 71, a flow flowing through the first inner channel 326, and a flow flowing through the second inner channel 327.

The flow of the lubricant 9 flowing through the space between the cylindrical part 323 of the orbiting scroll 32 and the slider 71, in particular, flowing through the lubricant flowing space 73 is further split into a flow flowing through a portion close to the main bearing part 22 of the main frame 2 and a flow flowing through a portion close to the intra-frame lubricant storage. The lubricant 9 flowing through the portion close to the main bearing part 22 of the main frame 2 lubricates the portion where friction is produced between the main bearing part 22 and the crank shaft 6. The lubricant 9 flowing through the intra-frame lubricant storage is, as illustrated in FIG. 4, returned to the lubricant storage 121 of the shell 1 through the lubricant discharge hole 218 of the wall part 217 of the main frame 2 facing the weight part 722 of the bushing 7 and, by utilizing the self-weight, through the lubricant return pipe 23.

The lubricant 9 flowing through the first inner channel 326 is supplied to the lubricant channel groove 325 through the first connection hole 3261. Then, the lubricant 9 flows through the lubricant channel groove 325 while being guided by the wall inside the lubricant channel groove 325 and entirely lubricates a region between the outer circumferential region of the other-end surface 3212 of the second base plate 321 and the thrust plate 216. After the region between the second base plate 321 and the thrust plate 216 has been evenly lubricated, the excessive lubricant 9 drops into the intra-frame lubricant storage through the second Oldham grooves 324 and the surface of the thrust plate 216, and then, is returned to the lubricant storage 121 through the lubricant discharge hole 218 and the lubricant return pipe 23.

As illustrated in FIG. 6, the lubricant 9 flowing through the second inner channel 327 flows in the direction of the second connection hole 3271 and, a part of the lubricant 9 flowing through the second inner channel 327 flows in the direction of the second plug part 329. As is the case with the lubricant 9 flowing through the first inner channel 326, the lubricant 9 flowing in the direction of the second connection hole 3271 flows into the lubricant channel groove 325 and lubricates the other-end surface 3212 of the second base plate 321 and the thrust plate 216. The flow amount of the lubricant 9 having flowed to the second plug part 329 is adjusted by the through hole 3291. Then, the lubricant 9 is discharged through the side surface of the second base plate 321. The amount of the lubricant 9 discharged through the second plug part 329 can be adjusted also by the viscosity.

The flow of the lubricant 9 having discharged through the side surface of the second base plate 321 is further split into a flow flowing toward the thrust plate 216 and a flow flowing up toward the one-end surface 3211 of the second base plate 321, that is, subjected to lubricant upflow. The lubricant 9 having flowed toward the thrust plate 216 lubricates the region between the other-end surface 3212 of the second base plate 321 and the thrust plate 216.

The lubricant 9 flowing up toward the fixed scroll 31 enters the compression space 34, thereby lubricating a portion where the orbiting scroll 32 slides against the fixed scroll 31 and serving as a seal that prevents leakage of the refrigerant through the gaps between the scroll bodies and the base plates. However, when the upflow amount of the lubricant 9 is excessively large, the lubricant 9 is moved to a heat exchanger through the discharge pipe 131 of the shell 1 and stored in the heat exchanger. This action causes reduction of heat exchange efficiency. In contrast, when the amount of the lubricant is excessively small, the amount of the lubricant 9 supplied to the region where the orbiting scroll 32 slides against the fixed scroll 31 is reduced. This action causes insufficient lubrication and insufficient sealing. To solve this problem, it is preferable that the discharge amount of the lubricant 9 through the second plug part 329 be adjusted to be an appropriate upflow amount of the lubricant 9. For example, the area of the channel of the through hole 3291 for the lubricant 9 is made to be smaller than the area of the channel of the second inner channel 327. Furthermore, when the diameter of the hole of the second inner channel 327 is R1 and the diameter of the through hole 3291 is R2, a relationship of which R2/R1 is from 30 to 50% is satisfied.

Figure 7:
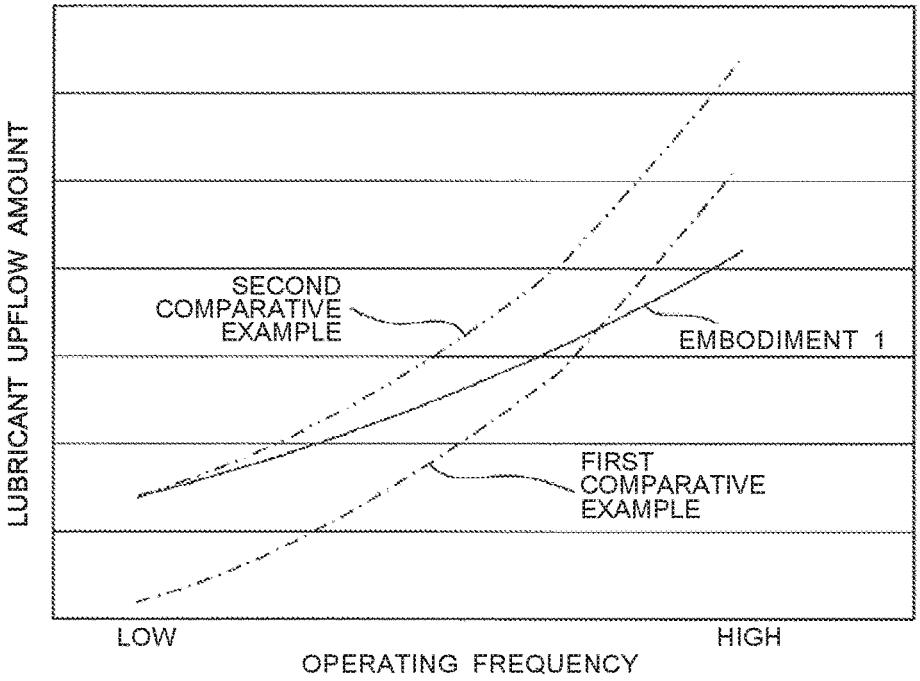
FIG. 7 explains lubricant upflows according to Embodiment 1 and comparative examples.

Next, the lubricant upflow according to Embodiment 1 due to variation of an operating frequency (rotation frequency of the crank shaft) of the compressor is described with reference to FIG. 7. FIG. 7 explains the lubricant upflows according to Embodiment 1 and comparative examples. A first comparative example corresponds to a compressor in which, as is the case with Patent Literature 1, the intra-frame lubricant storage is filled with the lubricant 9 and the lubricant 9 flows up due to an overflow caused by a lubricant pressure. A second comparative example corresponds to a compressor in which the total amount of the lubricant 9 is increased from that of the first comparative example.

As can be seen from FIG. 7, according to Embodiment 1 and the first and second comparative examples, as the operating frequency increases, the amount of the lubricant upflow increases. However, variation of the lubricant upflow amount between high-speed operation and low-speed operation is smaller with Embodiment 1 than with the first or second comparative example. That is, according to Embodiment 1, the lubricant upflow amount is stable even when the operating frequency varies. In contrast, according to the first comparative example, although an appropriate lubricant upflow amount can be obtained at middle to high operating frequencies, the lubricant upflow amount is excessively small at low frequencies. When the lubricant upflow amount is excessively small, insufficient lubrication or insufficient sealing for the fixed scroll 31 and the orbiting scroll 32 may be caused. According to the second comparative example, although an appropriate lubricant upflow amount can be obtained at low to middle operating frequencies due to the increase in the total amount of the lubricant 9, the lubricant upflow amount is excessive at high frequencies. When the lubricant upflow amount is excessive, the lubricant 9 is moved to the heat exchanger through the discharge pipe 131 of the shell 1 and a refrigerant pipe and stored in the heat exchanger, and thus, the heat exchange efficiency is likely to reduce.

For a single rotation of the crank shaft, a specified amount of the lubricant is pumped up from the lubricant storage by the oil pump. Thus, the amount of the sucked up lubricant varies in proportion to the operating frequency. The amount of the sucked up lubricant reduces at low operating frequencies and increases at high operating frequencies. In a compressor that causes an overflow of the lubricant such as a compressor of the first or second comparative example, the amount of the lubricant supplied to the thrust bearing and the amount of the lubricant flowing upward and supplied to the compression space are determined in proportion to the amount of the lubricant stored in the intra-frame lubricant storage. Thus, when the amount of the lubricant supplied to the thrust bearing is made to be sufficient for low-speed operation, the lubricant upflow is excessive during high-speed operation. In contrast, when the lubricant upflow amount is made to be appropriate for high-speed operation, the lubricant at the thrust bearing is insufficient during low-speed operation. Thus, it is difficult to supply an appropriate amount of the lubricant for both the high-speed operation and the low-speed operation.

In contrast, according to Embodiment 1, the flow amount of the lubricant 9 sucked up by the crank shaft 6 is adjusted by the second plug part 329 through the second inner channel 327, and then, this lubricant 9 is discharged from the side surface of the second base plate 321 of the orbiting scroll 32 and made to flow upward. With this method, the amount of the lubricant 9 involved in the lubricant upflow can be adjusted. Thus, variation of the lubricant upflow amount can be reduced even when the operating frequency varies. Thus, compared to the overflow method, effects of the operating frequency are reduced, and an appropriate amount of the lubricant can flow upward in operation at low to high operating frequencies. Furthermore, as the lubricant 9 in the upflow lubricant storage of the orbiting scroll 32 is made to directly flow upward, time for the lubricant 9 to reach the compression space 34 can be reduced. Thus, even for a test run or a startup after a long-time stop, sealing properties and lubricating properties between the scrolls can be preferable.

Furthermore, with the method of supplying lubricant to the thrust bearing according to Embodiment 1, it is not required that the intra-frame lubricant storage be filled with the lubricant 9. Thus, the configuration can be used in which the lubricant discharge hole 218 is opened in the wall part 217 of the main frame 2 facing the weight part 722 of the bushing 7 to actively return the lubricant 9 in the intra-frame lubricant storage to the lubricant storage 121 of the lower shell 12 through the lubricant return pipe 23.

When the amount of the lubricant 9 in the intra-frame lubricant storage is reduced, the occurrence of an agitation loss, that is, production of resistance in the weight part 722 and the Oldham ring 33 due to the lubricant 9 during the rotation of the crank shaft 6 can be reduced. Such an agitation loss has been typically reduced by increasing the distance between the weight part 722 and an inner wall of the main frame 2. With the present structure, such design is not required. Thus, the size and the weight can be reduced. For further reduction of the agitation loss of the weight part 722, it is preferable that the lubricant discharge hole 218 be opened below the weight part 722, that is, in the proximity of the wall part 217 facing the side surface of the annular part 721 so that almost no part of the weight part 722 is immersed in the lubricant 9.

The agitation loss is significant during high-speed rotation of the crank shaft 6, during operation under the conditions that reduces the temperature of the lubricant 9, and during use of the lubricant 9 having high viscosity grade. However, the present structure is usable under such design and use conditions. In particular, nowadays, there exist demands for increasing the capacity of compressors for high-speed operation. The present structure significantly responds to the needs of the market.

Figure 8:
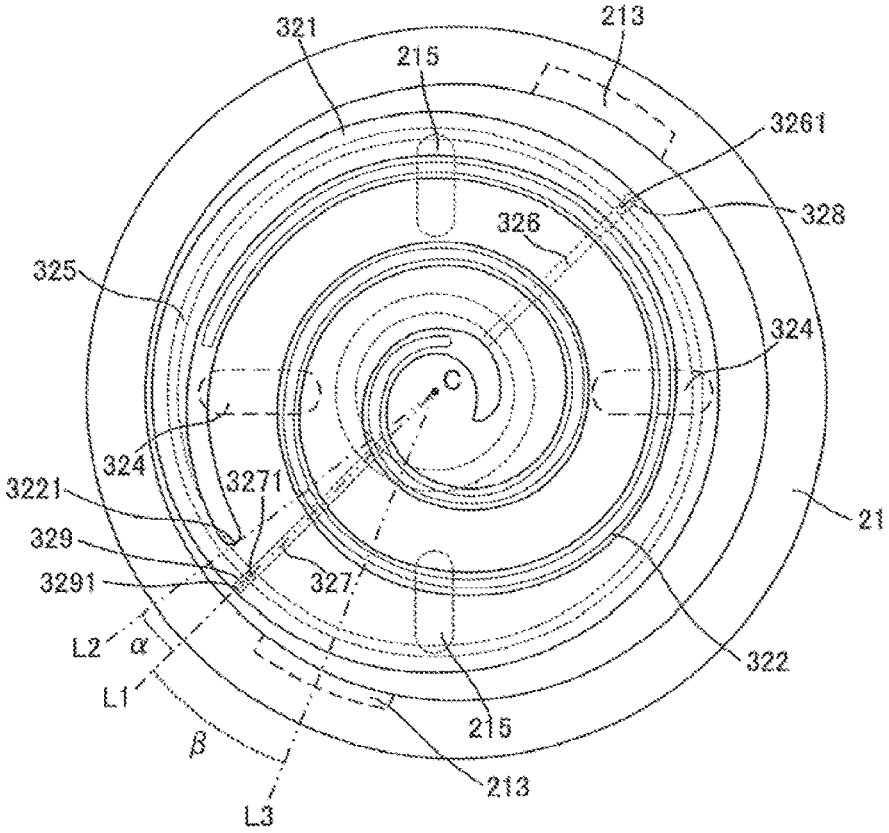
FIG. 8 illustrates the main frame and the orbiting scroll seen from the one end portion.

The lubricant upflow and whether the lubricant 9 enters the compression space 34 affect, for example, the positional relationship between the second plug part 329 and the second scroll body 322 of the orbiting scroll 32. Thus, the positional relationship of these components is described with reference to FIG. 8. FIG. 8 illustrates the main frame and the orbiting scroll seen from the one end portion.

As illustrated in FIG. 8, an angle α formed between a line L1 and a line L2 is 10 degrees or smaller. Here, the line L1 connects the center of the hole of the second inner channel 327 formed in the side surface of the second base plate 321 of the orbiting scroll 32 and a center C of the second base plate 321 to each other. The line L2 connects an outermost end part 3221 of the second scroll body 322 and the center C of the second base plate 321 to each other. That is, the hole of the side surface of the second inner channel 327 is opened in the proximity of the outermost end part 3221 of the second scroll body 322, that is, in the proximity of a winding end. This configuration facilitates entrance, through the winding end of the second scroll body 322, of the lubricant 9 having been discharged through the through hole 3291 of the second plug part 329 and flowed upward. As a result, the lubricant 9 can be efficiently supplied to the compression space 34.

Even in the case where the hole of the side surface of the second inner channel 327 is positioned closer to a winding start of the second scroll body 322 than is the outermost end part 3221 of the second scroll body 322, the lubricant 9 flowing upward can be efficiently introduced into the compression space 34 as long as the angle α is 10 degrees or smaller. A similar effect can be obtained when the angle α formed between the line L1 and a line L2 is 10 degrees or smaller in the case where line L1 connects the center of the hole of the second inner channel 327 formed in the side surface of the second base plate 321 of the orbiting scroll 32 and the center C of the second base plate 321 to each other, and the line L2 in this case connects an outermost end part (winding end) of the first scroll body 312 of the fixed scroll 31 and the center C of the second base plate 321 to each other.

Furthermore, as illustrated in FIG. 8, an angle β formed between the line L1 and a line L3 is 45 degrees or smaller. The line L1 connects the hole of the second inner channel 327 opened in the side surface of the second base plate 321 of the orbiting scroll 32 and the center C of the second base plate 321 to each other. The line L3 connects one of the refrigerant channels 213 of the main frame 2 and the center C of the second base plate 321 to each other. That is, the hole of the side surface of the second inner channel 327 is disposed in the proximity of the one of the refrigerant channels 213, through which the refrigerant passes between the inside and the outside of the main frame 2. Thus, the lubricant 9 having been discharged through the through hole 3291 of the second plug part 329 is likely to flow upward together with the refrigerant. As a result, the lubricant 9 can be efficiently supplied to the compression space 34.

As the orbiting scroll 32 orbits against the main frame 2, variation of timing causes the angle β to vary. Preferably, the above-described relationship is satisfied at any timing during the orbiting. Furthermore, in the case of a low-pressure shell method in which the refrigerant is sucked through the refrigerant channels 213 of the main frame 2, compressed in the compression space 34, and discharged through the hole at the central part of the fixed scroll 31, the lubricant 9 can be made to flow upward together with the refrigerant by using a suction pressure caused when the refrigerant passes through the refrigerant channels 213.

Figure 9:
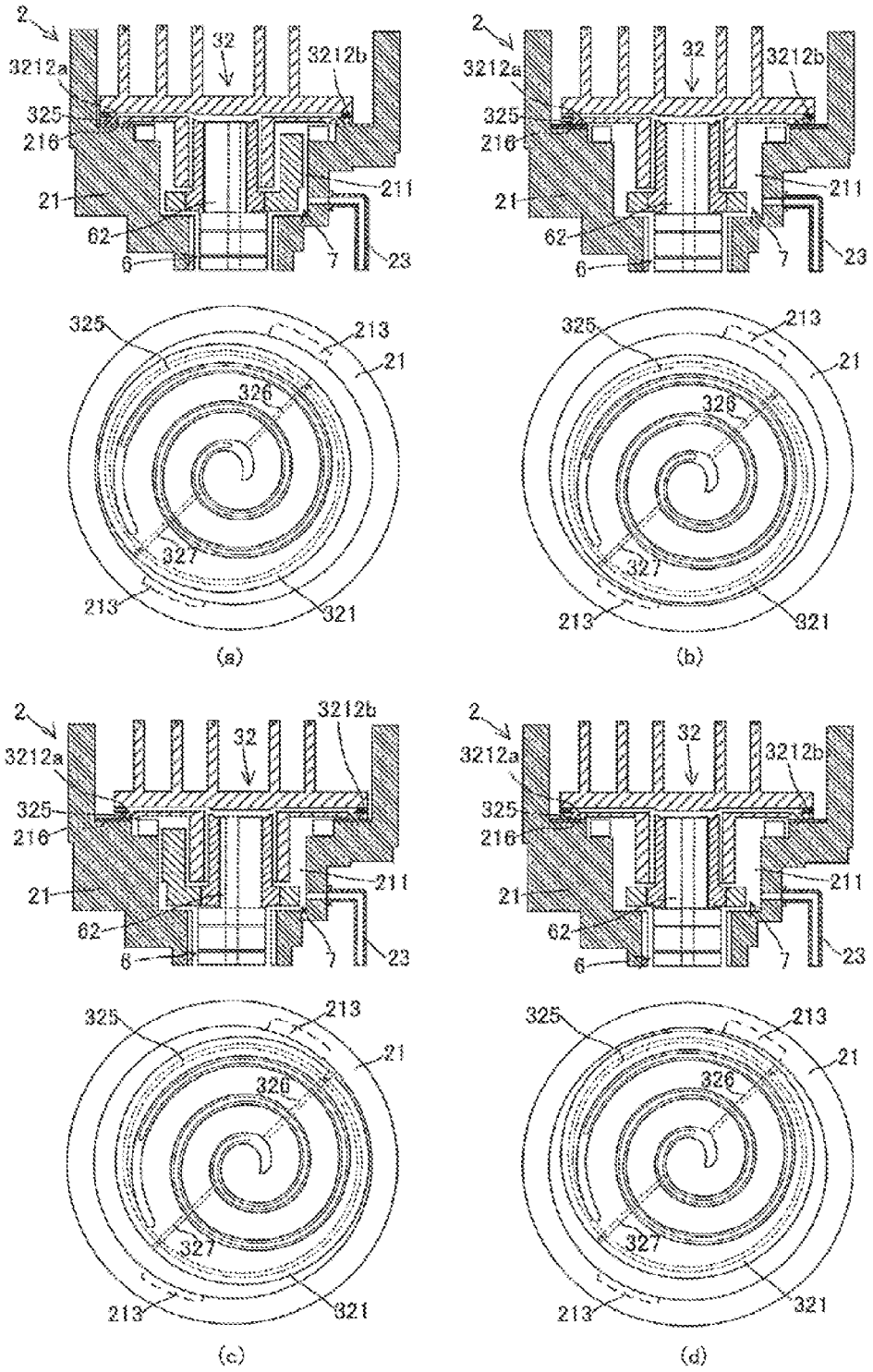
FIG. 9 includes views that explain orbiting states of the orbiting scroll against the main frame, and out of views (a) to (d), view (a) illustrates a reference state, view (b) illustrates a state in which a crank shaft is rotated through ¼ of a turn from the reference state, view (c) illustrates a state in which the crank shaft is rotated through ½ of a turn from the reference state, and view (d) illustrates a state in which the crank shaft is rotated through ¾ of a turn from the reference state.

Next, further details of the relationship between the main frame 2 and the orbiting scroll 32 during the orbiting are described with reference to FIG. 9. FIG. 9 includes views that explain orbiting states of the orbiting scroll against the main frame. View (a) illustrates a reference state, view (b)

illustrates a state in which the crank shaft is rotated through ¼ of a turn from the reference state, view (c) illustrates a state in which the crank shaft is rotated through ½ of a turn from the reference state, and view (d) illustrates a state in which the crank shaft is rotated through ¾ of a turn from the reference state.

View (a) of FIG. 9 illustrates the same state as the state illustrated in, for example, FIGS. 1 and 4. As described above, the lubricant channel groove 325 stays within a region of the thrust plate 216 and faces the thrust plate 216. As illustrated in view (b) of FIG. 9, when the crank shaft is rotated through ¼ of a turn from the reference state, the position of the orbiting scroll 32 is relatively shifted to the right from the reference state in sectional view.

Even in this state, the lubricant channel groove 325 stays within the region of the thrust plate 216 and faces the thrust plate 216. As illustrated in view (c) of FIG. 9, when the crank shaft is rotated through ½ of a turn from the reference state, the position of the orbiting scroll 32 is relatively shifted further to the right. Even in this state, the lubricant channel groove 325 stays within the region of the thrust plate 216 and faces the thrust plate 216.

As illustrated in view (d) of FIG. 9, when the crank shaft is rotated through ¾ of a turn from the reference state, the position of the orbiting scroll 32 is returned to a state similar to the state illustrated in view (b) of FIG. 9. Even in this state, the lubricant channel groove 325 stays within the region of the thrust plate 216 and faces the thrust plate 216.

When the crank shaft 6 is rotated, the orbiting scroll 32 orbits, for example, counterclockwise against the main frame 2 seen from the one end portion U, and the states of views (a), (b), (c), and (d) of FIG. 9 are repeated. Thus, even during the orbiting of the orbiting scroll 32, the lubricant channel groove 325 stays within the region of the thrust plate 216 and constantly faces the thrust plate 216.

When there is timing at which the lubricant channel groove 325 of the orbiting scroll 32 that is orbiting protrudes from the thrust plate 216, the lubricant 9 leaks toward the intra-frame lubricant storage at this timing to improve lubrication for a portion in which insufficient lubrication is likely to be locally caused by using the lubricant channel groove 325 according to Embodiment 1. That is, as the lubricant 9 is constantly supplied to the thrust plate 216 through the lubricant channel groove 325, the entirety of the portion where the orbiting scroll 32 slides against the thrust plate 216 can be stably lubricated. Furthermore, as the lubricant 9 in the upflow lubricant storage of the orbiting scroll 32 is directly introduced to the thrust bearing, time for the lubricant 9 to reach the thrust bearing can be reduced. Thus, even for a test run or a startup after a long-time stop, seizure of the thrust bearing can be prevented.

In a refrigeration cycle apparatus that includes a compressor, a condenser, an expansion valve, and an evaporator, use of a refrigerant containing R32, which is a high-pressure refrigerant that is likely to increase in pressure, as the refrigerant increases a burden borne by the thrust bearing. However, according to Embodiment 1, the lubricant 9 is stably supplied to the thrust bearing. Thus, even when the above-described refrigerant is used, seizure or other defect of the thrust bearing can be reduced. In the low-pressure shell method, in particular, a thrust load exerted on the thrust bearing increases. Thus, the fact that the pressure of R32 is high becomes a problem. However, this problem is likely to be solved with Embodiment 1.

Alternatively, when a refrigerant containing HFO-1234yf, the density of which is low, is used as the refrigerant of a refrigeration cycle apparatus, lubricant upflow along with suction of the refrigerant through the refrigerant channels 213 of the main frame 2 of the low-pressure shell method becomes difficult. However, according to Embodiment 1, control of an appropriate upflow amount of the lubricant is possible due to the function of adjusting the flow amount of the lubricant 9 by using the second plug part 329. Thus, even the refrigerant containing HFO-1234yf can be made to stably flow upward.

According to Embodiment 1, a crank shaft, an orbiting scroll, and a frame are provided. The crank shaft has a lubricant channel that allows a lubricant to flow through the lubricant channel. The orbiting scroll is attached to the crank shaft. The frame has a thrust surface against which the orbiting scroll slides. The orbiting scroll has an inner channel and a lubricant channel groove. The inner channel allows the lubricant supplied through the crank shaft to flow outward. The lubricant channel groove faces the thrust surface and allows the lubricant supplied through the inner channel to be supplied to the thrust surface. The lubricant channel groove is formed such that the lubricant channel groove stays within the region of the thrust surface while the orbiting scroll is orbiting.

That is, the lubricant channel groove faces the thrust surface during orbiting of the orbiting scroll. The orbiting scroll has a first sliding surface and a second sliding surface. The first sliding surface is provided at a portion further to the inside than is the lubricant channel groove. The second sliding surface is provided at a portion further to the outside than is the lubricant channel groove and has a smaller width than the width of the first sliding surface. Thus, during the orbiting of the orbiting scroll, a sufficient amount of the lubricant 9 can be stably supplied to the thrust bearing.

The orbiting scroll has a base plate and a cylindrical part that projects from one surface of the base plate. The lubricant channel groove is formed in the one surface of the base plate. The inner channel is connected to the inside of the cylindrical part at one end and connected to the lubricant channel groove at the other end. Furthermore, the base plate has a discoidal shape, and the lubricant channel groove is an annular groove provided in an outer circumferential region of the base plate.

Furthermore, the inner channel is formed along the one surface of the base plate and has a connection hole connected to the lubricant channel groove. Furthermore, the connection hole is inclined from the inner channel outward to be connected to the lubricant channel groove. Thus, a forming position of the lubricant channel groove 325 can be provided close to the outer end of the other-end surface 3212 of the second base plate 321. This configuration can facilitate forming of such a lubricant channel groove 325 that stays within a region of the thrust bearing while the orbiting scroll 32 is orbiting.

The inner channel penetrates an outer end surface of the base plate. A plug part is inserted at an outer end portion of the inner channel. When the length by which the plug part is inserted from the outer end surface of the base plate is D1 and a minimum distance between the outer end surface of the base plate and the connection hole is D2, a relationship of D1>D2 is satisfied. Thus, the channel in the second base plate 321 for the lubricant 9 can be easily formed while the forming position of the lubricant channel groove 325 is provided close to the outer end of the other-end surface 3212 of the second base plate 321.

The inner channel includes a first inner channel and a second inner channel provided opposite to the first inner channel across the axis of the crank shaft. The plug part is provided in the first inner channel, and an adjustment part is provided in the second inner channel. The adjustment part adjusts the flow amount of the lubricant and allows the lubricant to be discharged from the side surface of the base plate. Thus, the second inner channel allows an appropriate amount of the lubricant 9 that can flow upward to flow through. Thus, sealing properties and sliding properties between the fixed scroll 31 and the orbiting scroll 32 can be preferable.

A bushing that connects the orbiting scroll and the crank shaft to each other is further provided. The bushing includes a weight part provided at a portion of the bushing further to the outside than is the cylindrical part. Furthermore, the frame has a lubricant discharge hole at a wall part of the frame facing the weight part. This configuration can reduce the occurrence of the agitation loss of the weight part 722 caused by filling, with the lubricant 9, the space in the main frame 2 in which the weight part 722 of the bushing 7 is disposed.

The bushing has a flat surface that faces an inner wall surface of the cylindrical part of the orbiting scroll. When the sectional area of the lubricant flowing space defined by the flat surface and the inner wall surface of the cylindrical part is S1 and the sectional area of the inner channel is S2, a relationship of S1>S2 is satisfied. Thus, a configuration is possible that satisfies a relationship of M1>M2, where the amount of the lubricant 9 flowing through the lubricant flowing space 73 is M1 and the amount of the lubricant 9 flowing through the first inner channel 326 is M2. Thus, the amount of the lubricant 9 supplied to a portion where the crank shaft 6 slides against the main bearing part 22 can be larger than the amount of the lubricant 9 supplied to a portion where the orbiting scroll 32 and the thrust bearing orbit against each other. When a relationship of $0.05<M2/(M1+M2)<0.3$ is satisfied, an appropriate balance between the amount of the lubricant 9 supplied to the portion where the crank shaft 6 slides against the main bearing part 22 and the amount of the lubricant 9 supplied to the portion where the orbiting scroll 32 and the thrust bearing orbit against each other can be obtained.

The frame further has an Oldham groove that accommodates a part of an Oldham ring and a thrust plate provided on the thrust surface. A part of the Oldham groove is formed in the thrust surface. The orbiting scroll slides against the thrust plate, and the thrust plate covers at least a part of the Oldham groove. Thus, tolerance against a thrust load can be improved by the thrust plate 216. In addition, this configuration can reduce the occurrence of lubricant shortage due to flowing, through the second Oldham grooves 324, of the lubricant 9 moving through the lubricant channel groove 325.

Even when a high-pressure refrigerant such as R32 is used in the refrigeration cycle apparatus, the lubricant 9 can be stably supplied to the thrust bearing. Thus, seizure or other defect of the thrust bearing can be reduced. Also, even when a refrigerant that is difficult to flow upward due to low density of the refrigerant such as HFO-1234yf is used in the refrigeration cycle apparatus, lubricant can stably flow upward.

Embodiment 2

Figure 10:
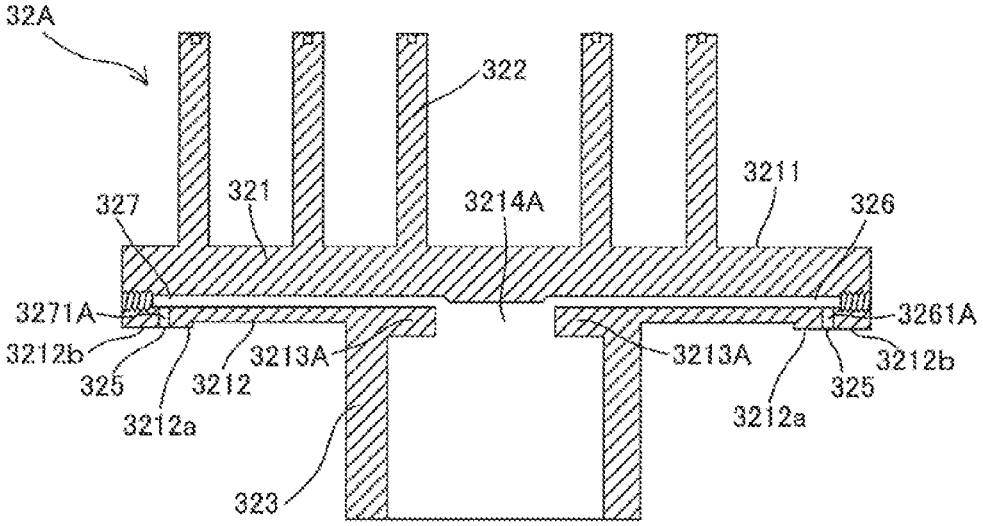
FIG. 10 is a sectional view of an orbiting scroll of the scroll compressor according to Embodiment 2 of the present invention.

FIG. 10 is a sectional view of the structure of an orbiting scroll of the scroll compressor according to Embodiment 2 of the present invention. In FIG. 10, parts having the same structures as those illustrated in FIGS. 1 to 9 are denoted with the same reference signs, thereby description of the parts is omitted.

As illustrated in FIG. 10, an orbiting scroll 32A according to Embodiment 2 has a projection 3213A projecting toward the center, at its portion close to the one end portion U in the cylindrical part 323. Thus, a lubricant storage space 3214A is defined at the center of a portion of the cylindrical part 323 close to the one end portion U. This lubricant storage space 3214A is resistive before the lubricant 9 sucked through the crank shaft 6 flows into the first inner channel 326 and the second inner channel 327. Thus, the flow amount of the lubricant 9 flowing through the first inner channel 326 and the second inner channel 327 can be adjusted. This configuration is particularly effective when it is desirable to limit the flow amount of the lubricant 9 flowing through the second inner channel 327, which includes the second plug part 329 serving as the adjustment part.

Furthermore, a first connection hole 3261A and a second connection hole 3271A are vertical holes orthogonal to the other-end surface 3212. When the first connection hole 3261A and the second connection hole 3271A are vertical holes, these holes are easily produced compared to the case where these holes are inclined holes.

The present invention is not limited to the invention according to Embodiment 1 or Embodiment 2 having been described, and the present invention may be appropriately modified without departing from the gist of the present invention.

For example, although the scroll compressor according to Embodiment 1 or Embodiment 2 having been described is a vertical scroll compressor, the techniques herein can also be applied to a horizontal scroll compressor.

Although the scroll compressor according to Embodiment 1 or Embodiment 2 having been described is a low-pressure-shell scroll compressor, the techniques herein can also be applied to a high-pressure-shell scroll compressor. However, when the thrust load applied to the thrust surface 212 by the orbiting scroll 32, the auxiliary effect of the suction of the refrigerant through the refrigerant channels 213 of the main frame 2 on lubricant upflow of the lubricant 9, and other factor are considered, the present invention is more suitable to the low-pressure-shell scroll compressor.

The thrust plate 216 is not necessarily provided. Instead, against the thrust surface 212, the orbiting scroll 32 may slide.

The first sliding surface 3212*a* and the second sliding surface 3212*b*, which are ring-shaped flat surfaces projecting from the other-end surface 3212 toward the other end portion L, may be flat surfaces at the same level as the level of the other-end surface 3212, that is, flush with the other-end surface 3212.

The lubricant channel groove 325 is not necessarily an annular groove. The lubricant channel groove 325 may be terminated by, for example, the second Oldham grooves 324 as long as the lubricant 9 can be sufficiently supplied to the entirety of the thrust bearing. The lubricant channel groove 325 does not necessarily have a ring shape, either.

Although at least one inner channel is required, three or more inner channels may be provided depending on the cases. For example, in addition to the pair of inner channels that are disposed on a substantially straight line across the crank shaft 6 and supply lubricant 9 to the lubricant channel groove 325, an inner channel that includes the second plug part 329 and is used for lubricant upflow may be provided. Furthermore, the sectional shape of the inner channels is not limited to a perfect-circular shape and may be, for example, an oval shape, an oblate circular shape, or a polygonal shape.

The second connection hole 3271 may be omitted when the lubricant 9 can be sufficiently supplied to the entirety of the thrust bearing by the first connection hole 3261 of the first inner channel 326 and the lubricant channel groove 325. In this case, the second inner channel 327 may instead be dedicated to adjustment of the flow amount of the lubricant 9 for lubricant upflow. Thus, adjustment of the flow amount by the second plug part 329 can be facilitated.

The first plug part 328 and the second plug part 329 are not necessarily metal screws. That is, as long as the first plug part 328 and the second plug part 329 can be inserted into and fixed to the holes of the first inner channel 326 and the second inner channel 327, the first plug part 328 and the second plug part 329 may be metal pins to be connected by an adhesive or elastic parts such as rubber to be connected by being press-fitted.

The method of adjusting the flow amount of the lubricant 9 using the second plug part 329 is not limited to the through hole 3291. The method with which the adjustment is performed, for example, by utilizing the gap between the second base plate 321 and the second plug part 329 may be used.

The through hole 3291 does not necessarily extend along the other-end surface 3212. For example, the through hole 3291 may be inclined in a lubricant upflow direction (outward and toward the one end portion U) to facilitate lubricant upflow. Furthermore, the diameter of the through hole 3291 may be varied.

REFERENCE SIGNS LIST

1 shell 11 main shell 111 suction pipe 12 lower shell 121 lubricant storage 122 fixing base 13 upper shell 131 discharge pipe 2 main frame 21 main body part 211 accommodating space 212 thrust surface 213 refrigerant channel 214 Oldham disposing part 215 first Oldham groove 216 thrust plate 217 wall part 218 lubricant discharge hole main bearing part 221 shaft hole 23 lubricant return pipe 3 compression mechanism unit 31 fixed scroll 311 first base plate 312 first scroll body 313 discharge port 32 orbiting scroll 321 second base plate 3211 one-end surface 3212 other-end surface 3212*a* first sliding surface 3212*b* second sliding surface 322 second scroll body 3221 outermost end part 323 cylindrical part 324 second Oldham groove 325 lubricant channel groove 326 first inner channel 3261 first connection hole 327 second inner channel 3271 second connection hole 328 first plug part 329 second plug part 3291 through hole 33 Oldham ring 331 ring part 332 first projection 333 second projection 34 compression space 35 discharge valve 36 muffler 361 discharge hole 4 drive mechanism unit 41 stator 42 rotor 5 sub-frame 51 sub-bearing part 52 oil pump 6 crank shaft 61 main shaft part 62 eccentric shaft part 63 lubricant channel 7 bushing 71 slider 711 flat surface 72 balance weight 721 annular part 722 weight part 8 power feed unit 81 cover 82 power feed terminal 83 wiring 9 lubricant U one end portion L other end portion

The invention claimed is:

1. A scroll compressor comprising:

a crank shaft having a lubricant channel allowing lubricant to flow through the lubricant channel;

an orbiting scroll attached to the crank shaft and including a base plate that is discoidal; and a frame having a thrust surface against which the orbiting scroll slides, wherein the thrust surface has an annular shape and facing an outer circumferential region of one surface of the base plate of the orbiting scroll, the orbiting scroll has an inner channel allowing the lubricant supplied through the crank shaft to flow outward and a lubricant channel groove, which has an annular shape in the outer circumferential region of the one surface of the base plate facing the thrust surface and which allows the lubricant supplied through the inner channel to be supplied to the thrust surface, the lubricant channel groove is formed such that the lubricant channel groove stays within a region of the thrust surface while the orbiting scroll is orbiting, the orbiting scroll has an orbit-scroll Oldham groove accommodating a part of an Oldham ring, the orbit-scroll Oldham groove is formed in the one surface of the base plate, and the lubricant channel groove is connected to the inner channel at one end and connected to the orbit-scroll Oldham groove at another end.

2. The scroll compressor of claim 1, wherein the orbiting scroll has a cylindrical part projecting from the one surface of the base plate, and wherein the inner channel is connected to an inside of the cylindrical part at one end and connected to the lubricant channel groove at another end.

3. The scroll compressor of claim 2, wherein the cylindrical part of the orbiting scroll has a projection projecting from an end part of the cylindrical part close to the base plate toward a center of the cylindrical part.

4. The scroll compressor of claim 2, further comprising a bushing connecting the orbiting scroll and the crank shaft to each other, wherein the bushing includes a weight part provided at a portion of the bushing further to an outside than is the cylindrical part.

5. The scroll compressor of claim 4, wherein the frame has a lubricant discharge hole at a wall part of the frame facing the bushing.

6. The scroll compressor of claim 4, wherein the bushing has a flat surface facing an inner wall surface of the cylindrical part of the orbiting scroll, and wherein, when a sectional area of a lubricant flowing space defined by the flat surface and the inner wall surface of the cylindrical part is S1 and a sectional area of the inner channel is S2, a relationship of S1>S2 is satisfied.

7. The scroll compressor of claim 6, wherein, when an amount of the lubricant flowing through the lubricant flowing space is M1 and an amount of the lubricant flowing through the inner channel is M2, a relationship of M1>M2 is satisfied.

8. The scroll compressor of claim 7, wherein a relationship of $0.05<M2/(M1+M2)<0.3$ is satisfied.

9. The scroll compressor of claim 1, wherein the inner channel is formed along the one surface of the base plate, and wherein the inner channel has a connection hole connected to the lubricant channel groove.

10. The scroll compressor of claim 9, wherein the connection hole is inclined from the inner channel outward to be connected to the lubricant channel groove.

11. The scroll compressor of claim 9, wherein the inner channel penetrates an outer end surface of the base plate, and a plug part is inserted into an outer end portion of the inner channel, and wherein, when a length by which the plug part is inserted from the outer end surface of the base plate is D1 and a minimum distance between the outer end surface of the base plate and the connection hole is D2, a relationship of D1>D2 is satisfied.

12. The scroll compressor of claim 11, wherein the inner channel includes a first inner channel and a second inner channel provided opposite to the first inner channel across an axis of the crank shaft, and wherein the plug part is provided in the first inner channel, and an adjustment part adjusting a flow amount of the lubricant and allowing the lubricant to be discharged from a side surface of the base plate is provided in the second inner channel.

13. A refrigeration cycle apparatus including the scroll compressor of claim 12, wherein refrigerant containing HFO-1234yf is used in the refrigeration cycle apparatus.

14. The scroll compressor of claim 1, wherein the orbiting scroll has a first sliding surface provided at a portion further to an inside than is the lubricant channel groove and a second sliding surface provided at a portion further to an outside than is the lubricant channel groove and having a smaller width than a width of the first sliding surface.

15. The scroll compressor of claim 1, wherein the frame further has a frame Oldham groove accommodating a part of the Oldham ring and a thrust plate provided on the thrust surface, wherein a part of the frame Oldham groove is formed in the thrust surface, wherein the orbiting scroll slides against the thrust plate, and wherein the thrust plate covers at least a part of the frame Oldham groove.

16. A refrigeration cycle apparatus including the scroll compressor of claim 1, wherein refrigerant containing R32 is used in the refrigeration cycle apparatus.

* * * * *